US008696939B2

(12) United States Patent
Negle

(10) Patent No.: US 8,696,939 B2
(45) Date of Patent: Apr. 15, 2014

(54) HIGH VOLTAGE INSULATING MATERIALS

(75) Inventor: Hans Negle, Nahe (DE)

(73) Assignee: Koninklijke Philips N.V., Eindhoven (NL)

( * ) Notice: Subject to any disclaimer, the term of this patent is extended or adjusted under 35 U.S.C. 154(b) by 1496 days.

(21) Appl. No.: 10/560,644

(22) PCT Filed: Jun. 4, 2004

(86) PCT No.: PCT/IB2004/050839

§ 371 (c)(1),
(2), (4) Date: Dec. 13, 2005

(87) PCT Pub. No.: WO2004/112055

PCT Pub. Date: Dec. 23, 2004

(65) Prior Publication Data

US 2006/0185889 A1 Aug. 24, 2006

(30) Foreign Application Priority Data

Jun. 18, 2003 (EP) ..... 03101785

(51) Int. Cl.
*H01B 17/00* (2006.01)
*H01B 1/00* (2006.01)

(52) U.S. Cl.
USPC ..... 252/500; 174/139

(58) Field of Classification Search
USPC ..... 174/139; 252/500–521.6
See application file for complete search history.

(56) References Cited

U.S. PATENT DOCUMENTS

| | | | | | |
|---|---|---|---|---|---|
| 3,573,210 | A * | 3/1971 | Furusawa et al. | ..... | 174/110 AR |
| 3,626,083 | A * | 12/1971 | Minter et al. | ..... | 174/137 B |
| 3,670,091 | A * | 6/1972 | Frantz et al. | ..... | 174/524 |
| 3,709,835 | A * | 1/1973 | Forster et al. | ..... | 252/513 |
| 3,950,304 | A * | 4/1976 | Inomata et al. | ..... | 524/445 |
| 4,109,098 | A * | 8/1978 | Olsson et al. | ..... | 174/106 SC |
| 4,219,791 | A * | 8/1980 | Moore et al. | ..... | 336/58 |
| 4,412,029 | A * | 10/1983 | Kehr et al. | ..... | 524/441 |
| 4,543,207 | A | 9/1985 | Sato et al. | | |
| 5,232,775 | A * | 8/1993 | Chamberlain et al. | ..... | 428/323 |
| 5,742,223 | A * | 4/1998 | Simendinger et al. | ..... | 338/21 |
| 5,756,936 | A | 5/1998 | Viebranz et al. | | |
| 6,541,534 | B2 * | 4/2003 | Allen et al. | ..... | 521/174 |
| 2002/0094443 | A1 | 7/2002 | Nakagawa et al. | | |

FOREIGN PATENT DOCUMENTS

| | | | | |
|---|---|---|---|---|
| EP | 1 176 856 | A2 | 1/2002 | |
| GB | 609133 | A1 | 9/1948 | |
| WO | WO 9608020 | A1 * | 3/1996 | ..... H01B 3/48 |

OTHER PUBLICATIONS

3M Product Literature—Scotchlite Glass Bubbles.*
Rome Cable Corporation, Rome Mine Power Cable—Type MP-GC, Romse-XLPE, Tape Shield, PVC Jacket, 8000 Volts, SPEC 6750, Jan. 1, 2003, 2 pages.

* cited by examiner

*Primary Examiner* — Mark Kopec
*Assistant Examiner* — Jaison Thomas

(57) ABSTRACT

High voltage insulating materials in solid and liquid form which are provided in particular for use in high voltage generators for example for radiotechnology and computer tomography. The solid insulating materials are characterized in particular in that they have a high dielectric strength while having a relatively low weight. Furthermore, the electrical conductivity of the insulating materials can be set relatively simply such that surface charges are reliably dissipated and voltage flashovers are avoided. Finally, with further embodiments, in particular in the case of hybrid insulating materials, it is possible to adapt or change the dielectric constant and/or the electrical conductivity of the insulating materials in a targeted manner such that the respective voltage drops over the insulting materials do not exceed the dielectric strength thereof.

22 Claims, No Drawings

HIGH VOLTAGE INSULATING MATERIALS

The invention relates to high voltage insulating materials in solid and liquid form, in particular for use in high voltage generators, and also to high voltage generators comprising such an insulating material for example for radiotechnology and computer tomography. The invention finally also relates to an X-ray system having a high voltage generator which comprises such an insulating material.

Various requirements are placed on modern high voltage devices such as in particular high voltage generators of for example X-ray systems, depending on the type of system.

On the one hand, the high voltage generators and their components should have a lasting high voltage stability which is sufficient under all operating conditions. This means that an arrangement has to be found and an insulating material has to be used which can reliably prevent both voltage flashovers on account of surface charges on individual components and also voltage breakdowns through the insulating material.

This applies in particular in the case of modern high voltage generators with a high power density since by using increasingly high operating frequencies the power components (for example high voltage transformers, cascades, etc) become increasingly smaller, the high voltage generators thereby become increasingly compact and consequently the field strengths which occur become increasingly high.

On the other hand, the high voltage generators should have as low a weight as possible, in particular in the case of rotating systems such as for example in computer tomography devices. Since these devices moreover operate at very high rotational speeds, the components which rotate along with them are exposed to high acceleration, so that their mechanical structure should also be very stable and as small and as compact as possible.

In order to ensure sufficient high voltage stability in a space that is becoming increasingly small, the insulating material in the high voltage generator is of course highly important. One problem here is, however, the fact that an insulating material with a particularly low weight (i.e. low density), as is required for the reasons given above, usually has only a relatively low dielectric strength.

One further requirement is for there to be no need for the use of insulating paper in high voltage generators, since said insulating paper requires complex impregnation processes. Instead, it is desired to realize the insulation using plastics technology alone, giving the advantage that the insulating material at the same time can also function as a support for the relevant components and by virtue of injection molding can be given a shape that is optimally adapted to almost any interior of a high voltage generator.

Where appropriate, there can thus also be formed in the high voltage generator areas or channels into which a liquid insulating material is fed in order to cool individual components. In the case of such hybrid insulation, as disclosed in EP 1 176 856, it must however be ensured that by virtue of the different properties of the solid and liquid insulating materials, in particular in terms of the electrical conductivity and dielectric constant thereof, voltage breakdowns do not occur at any point of the hybrid insulation.

Finally, account should also be taken of the fact that high voltage generators can be exposed by certain applications to a mixed loading of DC voltage, AC voltage and unipolar pulsating voltages, by virtue of which the requirements on the insulating material, particularly in the case of hybrid insulation, are increased even further on account of the different voltage drops in the solid and liquid insulating materials.

It is a general object of the invention to provide a high voltage insulating material which can be optimized in a relatively simple manner to one or more of the abovementioned requirements of a high voltage device.

In particular, a high voltage insulation material is to be provided which can reliably prevent both voltage flashovers on account of surface charges on individual components of a high voltage device (in particular high voltage generator) and also voltage breakdowns through the insulating material.

Furthermore, a high voltage insulating material is to be provided which has a particularly low weight without it being necessary to take account of substantial limitations in terms of its voltage stability.

A high voltage insulating material is also to be provided which is particularly suitable for use as hybrid insulation in a high voltage generator for example in accordance with the disclosure in EP 1 176 856 and compared to the latter has an improved stability with respect to voltage flashovers on account of surface charges and/or an improved stability with respect to voltage breakdowns through the insulating material.

Finally, a high voltage generator comprising an insulating material is also to be provided which has a reliable dielectric strength which is sufficient under all realistic operating conditions, in particular even mixed loading, while having a relatively low weight and/or a particularly small and compact design.

This object is achieved as claimed in claim 1 by a high voltage insulating material, the electrical conductivity and/or dielectric constant of which is changed by adding at least one further material such that when it is used in a high voltage device the voltage drops that occur during operation remain below flashover and/or breakdown voltages of the insulating material.

One advantage of this solution is that for example surface charges which gather on components of a high voltage device can be dissipated by increasing the electrical conductivity of the insulating material at least such that voltage flashovers can no longer occur.

A further advantage of this solution is obtained in the case of hybrid insulating materials, that is to say those of different type such as in particular solid and liquid insulating materials. Since these usually have different electrical conductivities and/or different dielectric constants, correspondingly different DC or AC voltage drops occur at these materials which in each case in at least one of the insulating materials may exceed the dielectric strength thereof. By adapting the electrical conductivities and/or the dielectric constants in accordance with the dielectric strengths, an optimal distribution of the voltage drops and hence an overall higher dielectric strength of the hybrid insulating material can be achieved.

Although US 2002/0094443 A1 discloses a solid insulating material in the form of a syntactic polyimide foam which is formed of a polymer matrix comprising hollow spherical particles of glass, carbon, metal, ceramic or a polymer which are filled with a gas, this foam is, as also mentioned therein, not suitable for insulating electrical components and has a very high dielectric constant. For this reason, said document is not regarded as relevant with regard to the problem according to the invention.

The dependent claims contain advantageous developments of the invention.

Claims 2 to 8 relate to solid insulating materials. By introducing the essentially spherical particles, a foam-like insulating material with cavities of the same or desired size and also a highly uniform distribution of these cavities in the insulating material can be produced.

The insulating materials as claimed in claims 3 and 4 have the advantage that they have a particularly low weight.

The insulating material as claimed in claim 6 has the advantage that its electrical conductivity can be set to a desired value in a relatively precise and reproducible manner.

Claims 9 to 12 relate to liquid insulating materials, where the embodiments as claimed in claims 9 and 10 can be set relatively simply in terms of their electrical conductivity and the embodiments as claimed in claims 11 and 12 allow relatively simple setting of their dielectric constant.

Claims 13 and 14 finally relate to high voltage generators comprising in particular hybrid insulation, that is to say a combination of a solid and a liquid insulating material, these high voltage generators being particularly suitable for use in radiotechnology.

Further details, features and advantages of the invention emerge from the following description of preferred embodiments of the invention.

A first embodiment is a solid high voltage insulating material in the form of an insulating foam which on account of its low weight is particularly suitable for use in high voltage generators for the abovementioned rotating X-ray systems.

This insulating foam comprises as basic substance for example essentially a polymer matrix which has a dielectric constant $\in_r$ of about 3 to 4.

Into this polymer matrix there is introduced, as further material, a filler in the form of spherical particles, in particular hollow spheres. Compared to known methods of producing foam-like insulating materials, the advantage is obtained here that the cavities formed by the spherical particles have a size that corresponds to that of the particles and can thus be set very precisely and is reproducible.

Furthermore, a significantly more uniform distribution of the cavities in the insulating material than with most known relevant methods can be obtained if the weight of the spherical particles and in particular the material of which the latter are produced are selected such that when they are introduced into the not yet hardened basic substance they neither sediment to a great extent nor float, so that a very high and desirable degree of filling can also be achieved.

If, moreover, a known wetting and dispersing additive is introduced in order to control the thixotropy and/or viscosity, the degree of filling can be further increased.

The filler or spherical particles is/are produced by a method known per se, and thus no further details will be given here.

The resulting cavities—unlike many known insulating foams—do not change even if the insulating material is foamed into a casing or the like with very different wall thicknesses. Moreover, the carbonization (combustion by exothermy) that is to be observed in known insulating foams and in the case of large wall thicknesses on account of the process does not occur here.

By virtue of a suitable choice of the material of which the hollow spheres are produced, by virtue of the size and number thereof in the insulating material and by virtue of the type of gas contained in the hollow spheres and the pressure of said gas, the dielectric constant of the insulating material can be adapted or changed in a desired manner.

The spherical particles are in particular hollow spheres which preferably have a diameter of for example up to about 100 μm.

The hollow spheres may be made for example of glass, a (capacitor) ceramic or phenolic resin, an acrylonitrile copolymer or of any other insulating material such as for example a thermoplastic or duroplastic material.

The hollow spheres may contain a gas such as for example sulfur hexafluoride ($SF_6$) or isopentane or other gases which, as mentioned above, may also be introduced under an increased pressure.

Thus, for example, the dielectric constant of the insulating material may be reduced further the greater the fraction of gas in the insulating material. This fraction increases as the number and diameter of the hollow spheres increase. At the same time, the weight of the insulating material may of course also be reduced by virtue of these two measures.

Moreover, by suitably selecting the diameter of the hollow spheres and also the type and pressure of the gas contained, the dielectric strength of the insulating material can also be influenced. For this purpose, the gas pressure in the hollow spheres and also the diameter of the latter are to be adapted to one another in a manner known per se such that partial discharges in the hollow spheres are avoided.

By using an adhesion promoter, the adhesion of the hollow spheres to the basic substance can be improved and thus the high voltage stability of the insulating material can be further increased. In the case where the hollow spheres are made of glass or ceramic, the adhesion to the polymer matrix can be increased by a silanization with about 0.1 to 0.3%. If the hollow spheres are made of a plastic, the adhesion to the polymer matrix can be improved by coating the plastic spheres with calcium carbonate.

By virtue of all these measures, a hard foam-like insulating material can thus be produced, the weight, dielectric constant and high voltage stability of which can be set within wide limits in a defined and reproducible manner.

Another problem which arises in particular in connection with the increasing use of high operating frequencies and the associated reduction in size of the power components (for example high voltage transformers, cascades, etc) and the increasingly compact design of the high voltage generators is that charges gather on the surface of solid insulating materials, which charges lead to voltage flashovers there and may result in destruction of the insulating arrangement and thus a fault in the high voltage generator (interface problem).

A dissipation of these charges and thus a further increase in particular in the load capacity in terms of DC voltage field strengths can be achieved by providing the spherical particles or hollow spheres formed from an electrically non-conductive material with an electrically conductive coating. It has been found that by means of this measure in conjunction with the above-described properties of the insulating material produced with the hollow spheres, such as the uniform distribution and size of the cavities produced in particular, the volume conductivity of the insulating foam can be set in a relatively precise and reproducible manner by virtue of the choice of density and/or size of the hollow spheres.

By virtue of this measure, the specific resistance of the insulating material can be reduced in a relatively simple manner to a preferred range of about $10^{10}$ Ωcm to about $10^{12}$ Ωcm, so that the abovementioned surface charges are effectively dissipated or at least reduced such that voltage flashovers can no longer occur.

The disadvantages which usually arise when conductive particles (silver, graphite, etc.) are mixed into the insulating material in order to reduce the resistance are thus also largely avoided. This is because in this case there is a very high dependency between the amount of particles (i.e. their degree of filling) and the drop in the resistance. This is essentially based on the fact that as soon as individual conductive particles in the insulating material come into contact (and thus a complex percolation path is formed), the resistance drops steeply and in particular there is very quickly a drop to below the abovementioned preferred range. This is not to be feared with the coated and very uniformly distributed spherical particles.

Overall, a targeted field control both in terms of the AC voltage loading, namely by setting the dielectric constant, and in terms of the DC voltage loading, namely by setting the specific resistance of the insulating material, are thus possible with the insulating material according to the invention.

This has advantages in particular during use in X-ray systems since the high voltage generator is usually exposed by the latter to a mixed loading of DC voltage, AC voltage and unipolar pulsating voltages, in particular when it is operated in the limit range of the material load capacity.

It should be mentioned that the spherical particles, depending on the electrical requirements of the insulating material, may also have a shape that is only approximated to the ideal spherical shape.

A second embodiment of the invention is a liquid high voltage insulating material. This is preferably used in those high voltage generators (in particular having a high power density) which are to be constructed without insulating paper but instead using plastics technology alone (for example of thermoplasts or epoxy or other insulating resins) together with a liquid insulating material. This has the advantage that the complex impregnation processes associated with the insulating paper are no longer necessary.

Moreover, the (solid) insulating materials produced from thermoplasts in the form of high power injection molded parts may also at the same time function as a support so that, possibly in conjunction with a suitable filigree shaping of these parts, the compactness of the high voltage generator can be further increased and the dimensions thereof can be further reduced.

However, on account of the high field strengths there is again the risk here that certain surfaces, particularly those of the solid insulating material, will be relatively highly charged and hence the above-described interface problem is further intensified. This may develop to the extent that voltage flashovers occur on the surfaces even at a field strength which is still far below the field strength at which a breakdown of the insulating materials per se is to be feared.

In order to solve this interface problem, the solid insulating material may again be given a reduced specific resistance in accordance with the above-described first embodiment by introducing hollow spheres coated with an electrically conductive material, so that the charges may at least substantially dissipate.

As an alternative or in addition to this, using the liquid insulating material according to the second embodiment of the invention, which likewise has a specific resistance that is reduced in a targeted manner, the situation may be achieved that the surface charges on the solid insulating material are at least substantially dissipated by the liquid insulating material.

For this purpose, according to the invention a first substance is added to the liquid insulating material, said first substance as far as possible substantially or completely dissolving and slightly reducing the specific resistance of the solution. As a result of the fact that the substance dissolves, the advantage is obtained that the abovementioned percolation paths, which lead to a sudden reduction in the resistance, cannot form and thus a desired specific resistance of the liquid insulating material too can be set in a targeted and reproducible manner.

Conventional transformer oil or an ester liquid may for example be selected as basic substance of the liquid insulating material. In order to reduce the specific resistance, aromatics and/or alcohol (for example ethanol) may for example be added, specifically preferably in an amount such that the desired and necessary dielectric strength is still retained and the losses in the liquid are still tolerable.

By virtue of this setting of the specific resistance of the liquid insulating material and possibly of the solid insulating material according to the above description, a targeted field control or field distribution between solid and liquid insulating materials in terms of the DC voltage loading is also possible, so that the voltage drops in the two insulating materials (hybrid insulating material) are in each case not greater than the dielectric strength thereof.

The specific resistance of the liquid insulating material may be reduced for example to a range between about $10^{10}$ and about $10^{13}$ Ωcm as a function of the specific arrangement and configuration.

As an alternative or in addition to this, the dielectric constant of the liquid insulating material may in turn also be set or changed with respect to the dielectric constant of the basic substance in a desired manner in order to carry out, in a targeted manner, a field control with respect to the AC voltage loading of the insulating material. For example, a second substance such as castor oil, which has a dielectric constant $\in_r$ of about 8, may be added to the transformer oil as basic substance ($\in_r$=2.1) in order to increase the dielectric constant of the overall insulating material.

Particularly advantageously, the solid and liquid insulating materials according to the invention can be used in combination with one another.

This is to be considered for example when a high voltage generator has a hybrid insulation in which there are in a solid insulating material channels into which a liquid insulating material is fed in order for example to be able to better dissipate the heat from particularly highly thermally loaded areas than is possible with the solid insulating material. A high voltage generator with such hybrid insulation is disclosed in EP 1 176 856, (also published as U.S. Pat. No. 6,498,303), which is fully incorporated by reference herein.

In the case of such hybrid insulation, both the specific resistances and the dielectric constants of the solid and liquid insulating materials can be advantageously adapted to one another in accordance with what has been stated above such that on the one hand surface charges are reliably dissipated and on the other hand the loading by DC and AC voltage fields can be distributed in an optimized manner over the two insulating materials so that the respective voltage drops do not exceed the respective dielectric strength.

By virtue of the targeted field control with regard to the DC voltage and AC voltage loading of the two insulating materials, the dielectric strength of the hybrid insulating material can be further improved and the casing design of the relevant device can be made even smaller. In particular, by reliably dissipating surface charges full use can be made of the dielectric strength of the insulating material and hence the field strength in the overall system can be correspondingly increased.

The invention claimed is:

1. A voltage generator in which an electrical insulating material is implemented for electrical insulation, said electrical insulating material comprising:

a first material; and a second material distributed within the first material to thereby increase electrical conductivity for, by dissipation of charge, preventing voltage flashover, said insulating material having a specific resistance greater than $10^{10}$ Ωcm and less than $10^{12}$ Ωcm.

2. An X-ray system having a voltage generator as claimed in claim 1.

3. The voltage generator of claim 1, wherein individual power components of said voltage generator are mutually separated by said electrical insulating material so as to prevent voltage flashover on account of surface charges on said components.

4. A method for providing hybrid electrical insulating material to prevent voltage flashover comprising:

combining two or more formed composite electrical insulating materials to create said hybrid electrical insulating material, the forming of a composite electrical insulating material comprising distributing within a first material a second material to thereby increase electrical conductivity for, by dissipation of charge, preventing said voltage flashover, said composite electrical insulating material having a specific resistance greater than $10^{10}$ Ωcm and less than $10^{12}$ Ωcm.

5. The method of claim 4, two of said formed composite electrical insulating materials being combined, one being a liquid and the other being a solid.

6. An electrical insulating material for a voltage generator, said generator for receiving an input voltage, increasing the received voltage, and making available, as output, the increased voltage, said insulating material comprising:

a first material; and a second material distributed within said first material to thereby increase electrical conductivity for, by dissipating charge, preventing voltage flashover during operation of said generator, said insulating material being shaped for implementation within an interior of said generator to provide electrical insulation between components of said generator.

7. An electrical insulating material as claimed in claim 6, said generator being operable at a continuous power of 15 kW with mixed loading that includes a direct current voltage.

8. An electrical insulating material comprising:

a first material; and a second material comprising electrically conductive material, said second material coating a further material comprising particles, and being distributed within said first material to thereby increase electrical conductivity for, by dissipation of charge, preventing voltage flashover, said particles having an additional coating comprising a material that improves adhesion between said particles and said first material.

9. The electrical insulating material of claim 8, said first material having a dielectric constant greater than 3 and less than 4.

10. The electrical insulating material of claim 8, wherein said insulating material hardens into a hard foam-like material.

11. The electrical insulating material of claim 8, further comprising a wetting and dispersing additive to control at least one of thixotropy and viscosity of said first material.

12. The method of claim 8, wherein said particles are embedded in said first material to which there is added said material that promotes adhesion.

13. An electrical insulating material comprising:

a polymer having a dielectric constant greater than 3 and less than 4; and a second material comprising electrically conductive material, said second material coating a further material comprising particles, and being distributed within said polymer to thereby increase electrical conductivity for, by dissipation of charge, preventing voltage flashover, said electrical insulating material being a hard, foam-like material.

14. A method for making an electrical insulating material comprising:

distributing within a first material a second material so as to thereby increase electrical conductivity for, by dissipation of charge, preventing voltage flashover, said second material coating particles;

introducing, into said particles, gas to set internal gas pressure according to particle size so as to avoid intra-particle partial discharges; and selecting said pressure to achieve a targeted dielectric strength of said electrical insulating material.

15. A hybrid electrical insulating material for implementation within an interior of an electrical device, said hybrid electrical insulating material comprising:

a solid electrical insulating material; and a liquid electrical insulating material, each of said solid and said liquid electrical insulating material comprising:

a respective first electrical insulating material; and a respective further material, said respective further material being added to the respective first material so as to change at least one of electrical conductivity and a dielectric constant and to prevent voltage drops that occur during operation of said electrical device from reaching correspondingly flashover, or breakdown, voltage of said hybrid electrical insulating material.

16. The hybrid electrical insulating material of claim 15, the addition of said further material lowering specific resistance for at least one of said solid and liquid electrical insulating material to thereby prevent voltage flashover.

17. The hybrid electrical insulating material of claim 16, said addition of said further material lowering both specific resistances to thereby prevent voltage flashover.

18. The hybrid electrical insulating material of claim 17, said lowered specific resistance of said solid electrical insulating material being greater than $10^{10}$ Ωcm and less than $10^{12}$ Ωcm, said lowered specific resistance of said liquid electrical insulating material being greater than $10^{10}$ Ωcm and less than $10^{13}$ Ωcm.

19. An electrical device having an interior and, implemented within said interior, a voltage insulating liquid material, said material including a basic material and at least one further material, the electrical conductivity, dielectric constant or both of said voltage insulating liquid material differing from those of said basic material such that, when said voltage insulating liquid is used in said device, voltage drops that occur during operation of said device remain below flashover voltages, below breakdown voltages, or below both flashover and breakdown voltages of said voltage insulating liquid material so as to avoid correspondingly flashover or voltage breakdown, one or more of said at least one further material being a first substance dissolved in a liquid basic substance, said basic substance being an insulating liquid and said first substance being an aromatic, an alcohol, or a combination of an aromatic and an alcohol.

20. The electrical device of claim 19, said voltage drops remaining below flashover voltages.

21. The electrical device of claim 19, further implemented within said interior with voltage insulating solid material that, together with said voltage insulating liquid material, constitute a voltage insulating hybrid material.

22. The electrical device of claim 19, implemented as a voltage generator.

* * * * *